United States Patent [19]

Sampey

[11] 3,994,026

[45] *Nov. 30, 1976

[54] GARMENT WITH SUPPORTED DROP SEAT

[75] Inventor: Gladys LeBlanc Sampey, LaFourche Parish, La.

[73] Assignee: Johnny X. Allemand, Thibodeax, La. ; a part interest

[ * ] Notice: The portion of the term of this patent subsequent to Apr. 13, 1993, has been disclaimed.

[22] Filed: July 7, 1975

[21] Appl. No.: 593,482

Related U.S. Application Data

[63] Continuation-in-part of Ser. No. 473,993, May 28, 1974, Pat. No. 3,949,427.

[52] U.S. Cl. ..... 2/79; 2/DIG. 6

[51] Int. Cl.[2] ..... A41D 13/02

[58] Field of Search ..... 2/78 B, 79, 78 A, 78 R, 2/DIG. 6

[56] References Cited

UNITED STATES PATENTS

| | | | |
|---|---|---|---|
| 2,263,146 | 11/1941 | Smith | 2/79 |
| 2,717,437 | 9/1955 | De Mestral | 2/DIG. 6 |
| 2,849,717 | 9/1958 | Klotz | 2/79 |
| 3,081,772 | 3/1963 | Brooks et al. | 2/DIG. 6 |
| 3,789,429 | 2/1974 | Garcia | 2/79 |

*Primary Examiner*—H. Hampton Hunter
*Attorney, Agent, or Firm*—Pugh & Keaty

[57] ABSTRACT

A jumpsuit garment with integral drop seat flap for, for example, convenient lowering of the lower rear portion of the jumpsuit for restroom facility usage. The garment of the present invention is worn as a garment over the torso of a man, woman, or child on at least the upper and central torso, and has utility for all types of dress, including casual, formal, work and recreational environments. The garment is one piece and usually full length and has an opening in the lower back portion for correct exposure of the derriere for toilet purposes which is covered by the drop seat flap. The drop seat flap utilizes uniquely positioned and designed means and belting for securing it closed when the drop seat flap is in the raised position (FIG. 6). The drop seat flap is connected to the body of the garment at the bottom edge and lower sides usually by stitching. During normal wear when the person is engaged in activities other than toilet activities, the drop seat portion is in the raised position covering the opening in the back of the device. The drop seat is connected at the sides of the waist at two points using a belt with buttonholes positioned to engage buttons mounted on the garment therethrough and with no other attachment type connection between the bottom portion of the device and the top connections (FIG. 2). The drop seat flap in the raised position covers a part of the garment which is analogous to the tail of an ordinary shirt or blouse and is also attached thereto by a "Velcro" type connection. The "Velcro" fastening in normal use maintains the drop seat in a closed, fixed position, but the "shirt tail" back portion of the garment reaches across its entire back portion and is connected at the side seams thereof and has, as an integral part of its design, two folds removed from the two side seams of the garment. These two folds are each secured at a point two to two-and-a-half inches below the shoulder seam and extend the full length of the back "shirt tail" portion of the garment and are used to permit freer range of movements of the wearer that involve back expansion and stretching as part of the movement. At the lowest extension of the "shirt tail" portion, two free vertical slits are made in the fold to permit freer range of movements of the wearer that involve hip expansion as part of the movements of the wearer.

21 Claims, 6 Drawing Figures

GARMENT WITH SUPPORTED DROP SEAT

REFERENCE TO RELATED APPLICATION

This application is a continuation-in-part of the prior copending application Ser. NO. 473,993, filed May 28, 1974 and entitled "GARMENT WITH DROP SEAT" now U.S. Pat. No. 3,949,427 issued Apr. 13, 1976.

BACKGROUND OF THE INVENTION

The present invention relates to a garment which permits generally unrestricted physical movement and which has an integral, rear flap, termed in the art a "drop seat", for permitting, for example, toilet facility utilization by the wearer of the garment without the requirement of taking it off. The present invention has been found to be particularly applicable to the jumpsuit or worksuit types of garments, especially as a garment which permits workmen during their normal job duties to utilize toilet facilities without disrobing and hence will be discussed with particular reference thereto.

In the use of any type of jumpsuit garment which includes a drop seat feature, the drop seat is usually attached to the jumpsuit to form a single piece garment. The jumpsuit must be capable of permitting movements by the wearer of the jumpsuit without any strain on the wearer which for a workman may include sudden and great physical movements. It must also permit easy disengagement and lowering of the drop seat feature and reattaching it to the jumpsuit as desired. While the drop seat is in the raised position, it must stay securely connected in the raised position and not drop thereby causing embarrassment to the wearer. It is preferable for it to also seal the top of the drop seat across the back when not in the lowered position for further modesty. Thus, it is necessary to securely fasten the drop seat to the rest of the jumpsuit in the raised position of the drop seat while at the same time permitting full range of physical movement by the wearer of the jumpsuit.

The broad concept of providing a garment with a slit in the back to provide easy access in the rear is a well known and established design in the prior art. Typical examples thereof in the undergarment arts include drop seats fastened at the side seams forming an overlapping slit in the back portion of the garment at the waist of the garment and held at the waist by elastic binding with the drop slit being movably over the derriere for toiletry purposes. Note for example, U.S. Pat. Nos. 1,787,098 (Wolff; issued December 30, 1930) and 1,871,086 (Rutledge; issued August 9, 1932).

However, this type of drop seat design is not amenable to worksuits or other outer garment construction. In the coverall art, supplemental fastenings are generally required. Jumpsuits with elastic waist binding and various non-belt attaching means for holding a back flap shaped piece of material in place over an opening cut in the jumpsuit garment are generally known in the prior art. The usual methods for supplemental fastening of the drop seat flap to keep it in place known in the prior art include botton fastening means in the front or the back, zipper fastening means along the side of the garment or the back of the garment at the waist, and elastic bands which push through loops that are sewn onto the jumpsuit garment at the waist and then attached by button means to the jumpsuit garment at the sides of the garment, which hold the drop seat to the jumpsuit (or analogous) garment. Note for example, U.S. Pat. Nos. 1,837,654 (Cohen; issued Dec. 22, 1931), 1,398,443 (Pendergrass; issued Nov. 29, 1921), 2,039,946 (Wolf et al; issued May 5, 1936), 3,088,116 (Simonoff; issued May 7, 1963), 1,659,451 (Sweeney; issued Feb. 14, 1928), 2,019,924 (Murphey; issued Nov. 5, 1935) and 1,546,428 (Anderson; issued July 21, 1925). However, these methods lack convenience in disengaging the drop seat from its waist connections to the jumpsuit and are difficult to fabricate because of the materials and structures involved.

Additionally, belting system techniques for attaching the drop seat flap the the rest of a garment when it is not in use and is in the raised position have been known in the prior art. The drop seat flap is usually connected to the belt by sewing the top of the drop seat to the belt as an integral connection, the belt of course binding in the front of the garment to hold the drop seat flap in the raised position and additionally by placing connections in the back of the garment to further support the drop seat flap by securing the belt in position. These connections are either O-rings, buttons, I-rings, or belt loops. Also, the belt is usually either directly sewn onto the side of the garment or additional fastenings sewn to the side of the garment and sewn to the belt. Note for example, U.S. Pat. Nos. 1,967,234 (Fellroth; issued July 24, 1934), 1,137,081 (Pine; issued Apr. 27, 1915), 2,357,532 (Menzin; issued Sept. 5, 1944), 2,093,903 (Bernstein; issued Sept. 21, 1937), 1,537,230 (Godbehere; issued May 12, 1925), 2,368,034 (Martin; issued January 23, 1945), and 1,785,581 (Fellroth; Dec. 16, 1930), which are directed to various types of drop seat garments, some of which are the jumpsuit type.

Also included within the prior art for belting system techniques for attaching the drop seat flap to the rest of the garment when the drop seat flap is not in use and is in the raised position are belt connections to attach the drop seat to the rest of the garment that use no other attachment of the belt to the garment except for the attachment of the drop seat to the belt, the drop seat feature of course being attached to the body of the garment at the bottom edge usually by stitching. The belts' front connection is used to support the drop seat in the raised position. Note for example, U.S. Pat. No. 1,485,793 (McKee; issued Mar. 4, 1924).

However, the prior art garments that use belting systems either entail more expensive fabrication techniques to provide for the additional attachment facilities as compared to the present invention or, when facilities are not provided for attaching the belt to the garment other than on the drop seat flap lower edge, provide less secure means for maintaining the body of the garment and the sides of the drop seat flap together when the drop seat flap is in the raised position. The additional attachment facilities for attaching the belt and drop seat flap to the garment also present difficulties in raising and lowering the drop seat flap when it is required for use of toilet facilities, thereby substantially increasing the time that the workman spends in undoing and redoing the drop seat flap connections.

Additionally, none of the prior art known to applicant discloses means for the securing of the drop seat flap in the raised position in multiple manners including detachably across the back for privacy while still permitting freedom of movement nor does the prior art provide hip expansion, when the shirt tail piece of the jumpsuit garment extends below the drop seat flap. The prior art fails to provide sufficient means to permit expansion for shoulder and back motions when physical acts by the wearer of the jumpsuit garment such as reaching are performed. Additionally, the belting system techniques of the prior art for connection of the drop seat flap to the jumpsuit garment inhibit the ability of the shirt portion of the jumpsuit garment to stretch independently of the drop seat flap and legs of the jumpsuit garment when reaching or bending actions are performed by the wearer of the jumpsuit garment if necessary by detachment at the back connection through sheer force.

In contrast to the prior art, which is plagued by the problems of keeping the drop seat flap firmly attached to the garment while permitting use of attachment methods necessary for external garments such as worksuits, permitting convenient lowering of the drop seat flap when necessary, and permitting great physical movements by the wearer of the garment especially those movements involving reaching, sitting and bending, the prevent invention utilizes a very simple but highly effective design to secure the drop seat flap firmly to the body of the jumpsuit garment. The design of the jumpsuit garment also allows secure connection of the jumpsuit garment to the drop seat flap while eliminating the problems of restrained physical movements and difficult to manage attachment and detachment of the jumpsuit garment from the top of the drop seat flap while supplying additional attachment for further modesty. The present invention, while utilizing a belt having a connection to the drop seat flap at its upper edge by integral sewing of the drop seat flap to the belt, utilizes attaching means of the belt to the jumpsuit garment that prevents slippage of the drop seat flap thereby keeping it securely connected to the jumpsuit garment.

The present invention utilizes a drop seat flap connected usually by stitching to the body of the jumpsuit garment at the bottom and lower side edges. The drop seat flap is additionally connected at its top edge to a belt which in the raised position of the drop seat flap is connected at the side of the jumpsuit garment at two points by button connection means with fixed connections to the jumpsuit garment between the button and lower side connections of the drop seat flap and further pressure connections between the two side connections of the belt to the jumpsuit garment such as a "Velcro" type connection. Additionally, the belt has at least one elastic piece in the back which stretches as the belt is connected to the two buttons and also as the belt is connected in front. Additional metal snap connections may also be used. Thus, the drop seat flap is secured in a multiple manner to the jumpsuit garment by the elastic, the pressure connections and the side connections of the belt while the drop seat flap is in the raised position. For disconnection purposes, the belt is disengaged in the front and the buttons are disengaged quickly and easily with the Velcro connection pulled there by sheer force, permitting the belt to be completely free to permit the drop seat flap to be lowered. Additionally, because the belting if fixedly attached at the side rather than the rear with the only rear connection being of the pressure type subject to disengagement automatically by sheer or normal forces, neither the belt nor its attachments restrain the back shirt portion of the jumpsuit garment from movement as the wearer of the jumpsuit garment moves. Therefore, stretching and bending is much more comfortable and less restrained as a result of free movement of the fabric of the back shirt of the jumpsuit garment when the drop seat flap is in the raised position while still permitting additional modesty connection during normal, unstrained wear. Also, the back shirting has an expansion fold permitting easy and comfortable reach by the arms of the wearer of the jumpsuit garment in either direction without fabric pulling. Moreover, the shirting of the jumpsuit garment extends below the line where the drop seat attaches to the jumpsuit garment at the belt to permit further protection and comfort in the jumpsuit garment cover by the drop seat flap. Additionally, the ends of the back shirting of the jumpsuit garment terminate with two slits hidden by the folds at each side of the back of the shirt which permits the shirt to expand across the hip area for greater freedom of movement of the wearer of the jumpsuit garment.

Thus in summary, the present invention provides a unitary body garment that covers at least the upper and central torso including the shoulders, back, "derriere", and upper thighs, and includes an improved "drop seat" design, the improvement in the "drop seat" comprising the following structure: a drop seat flap connected to the garment along its sides at only two points with pressure connection along the back of the garment, a bottom fixed connection and a top fastenable connection, with preferably no fixed or fastenable connections therebetween, and a tail piece bridging across the full back of the garment and having two, free, vertical slits therein, both slits being substantially removed from the side junction lines between the flap and the tail piece; and a belt at and across the upper end of the drop seat flap having at least partially along its length elastic sections as well as part of the pressure connection, the belt ends extending out past the side edges of the flap and being completely free from the body garment when the drop seat structure is used in operation.

The present invention further includes the additional features outlined below:

- the slits are hidden by folds;
- the elastic section is preferably in one part;
- the pressure connection is preferably in one part;
- quick release buttons are used for the fastenable connections;
- the tail piece extends below the fixed connection (for example ¾ inch) of the drop flap;
- the junction line is free of any slits.

As to the basic advantages of the present invention over the prior art, in general the present invention is simpler and easier to manufacture than the prior art and is simpler and easier to use and more comfortable in wear. Yet the drop seat structure of the present invention is at least as reliable, if not more reliable, in its closing and covering of the rear of the garment than the prior art.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

-Introduction-

The jumpsuit garment with integral drop seat flap, which is the preferred, embodiment of the present inventions, can be worn, for example, as a worksuit wherein it is important that the worksuit properly covers the worker and permit him great physical movement of his body and his arms and also to be able to quickly and easily disengage the drop seat flap in order to use toilet facilities with ease. A particularly important area of application of the present invention is thus in the fabrication and design of worksuits, and therefore the preferred embodiment will be described with respect to such an application. However, it should be appreciated that the present invention can be applied to all types of drop seat garments, whether for casual, formal, recreational or work dress.

-Structure and Method of Use-

Figure 1:
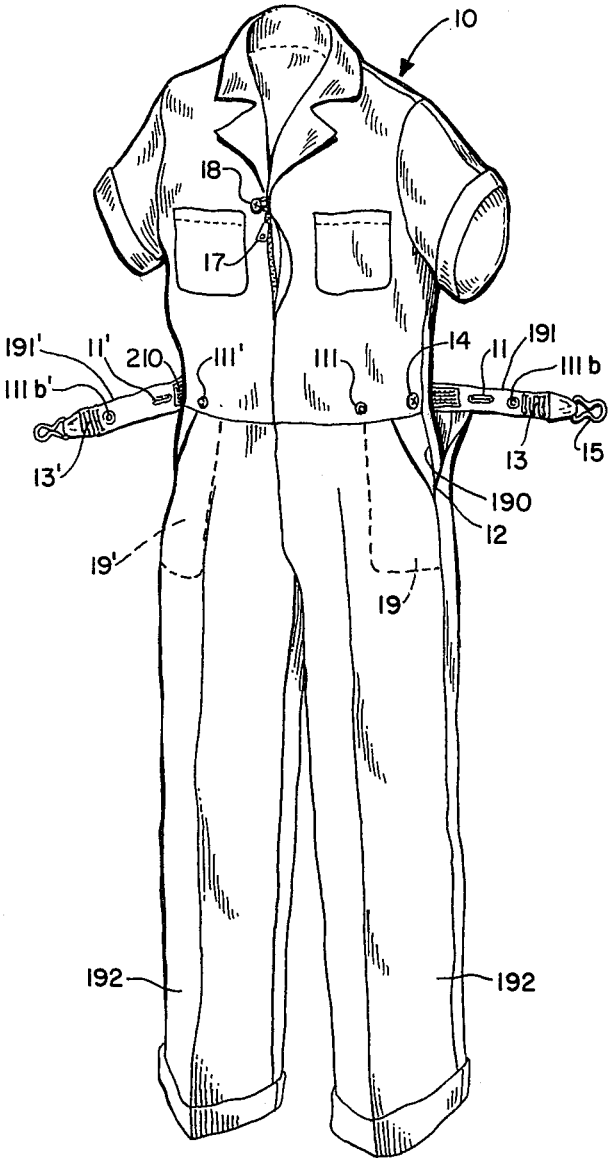
FIG. 1 is a frontal perspective view of the preferred embodiment of the jumpsuit garment of the present invention showing the garment with the belt of the drop seat flap in the raised position but disconnected from the jumpsuit garment device.
Figure 2:
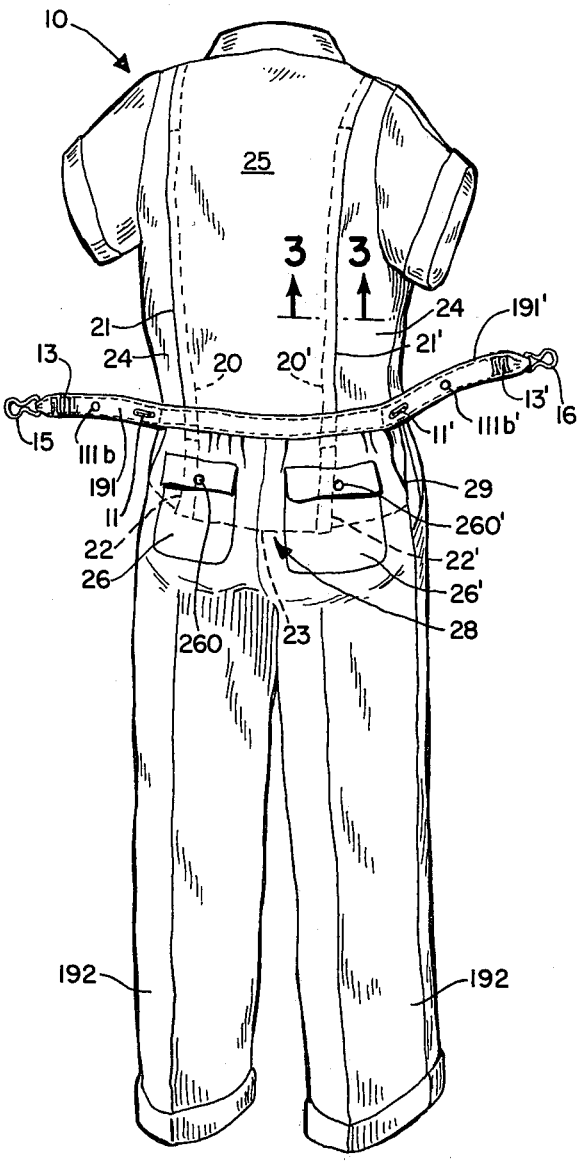
FIG. 2 is a back perspective view of the preferred embodiment of the jumpsuit garment of the present invention showing the belt of the drop seat flap detached from the jumpsuit garment and the drop seat flap in the raised position.

Referring to FIGS. 1 and 2, there is shown the jumpsuit garment 10 with integral drop seat flap device 28 of the present invention which can be used as a worksuit. The wearer gets into the worksuit 10 by getting into the pants' legs 192 while the belt 191 is detached with its clasp elements 15 and 16 not buckled, and the side jumpsuit garment button supports 14 and 14' and snaps **111*a*, 111*a'* (which connect to the belt 191, 191' and buttonholes 11 and 11' and snap connectors 111*b*, 111*b'* respectively) disengaged. After the top of the garment is slipped over the upper torso and arms, the front of the jumpsuit garment is zipped up to the top using zipper 17 and the top buttoned securely with button 18.**

The belt 191, 191', which is connected to the top of the drop seat flap 28, may then be attached by first pulling the buttonholes 11 and 11' to the waist buttons 14 and 14', respectively, stretching elastic section 13 to hold the drop seat flap taut and close to the body of the jumpsuit garment in the raised position of the drop seat flap 28, with the flap slightly overlapping the lower side seams 190 and with pressure closure 212 such as a "Velcro" tape connector with one side 210 on belt 191, 191' and the other side 211 on shirt back 25, providing additional, releasable closure for further modesty. The clasps 15 and 16 are then connected, further pulling the elastic sections 13, 13' and resealing closure 212 for a tighter fit. The fastened position for wear as a worksuit with the drop seat flap in the raised position.

The jumpsuit garment 10 has two front pockets which extend down the front legs as shown by the phantom line outlines 19 and 19'. It also has two back pockets 26 and 26' with snap connectors 260, 260'.

Figure 3:
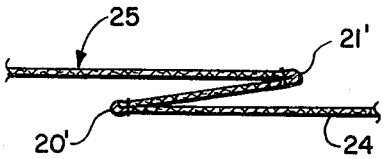
FIG. 3 is a detail, partial cross-sectional view, taken along section lines 3–3 of FIG. 2, of the back shirt fold of the preferred embodiment of the jumpsuit garment of the present invention showing the way the fold is constructed.
Figure 4:
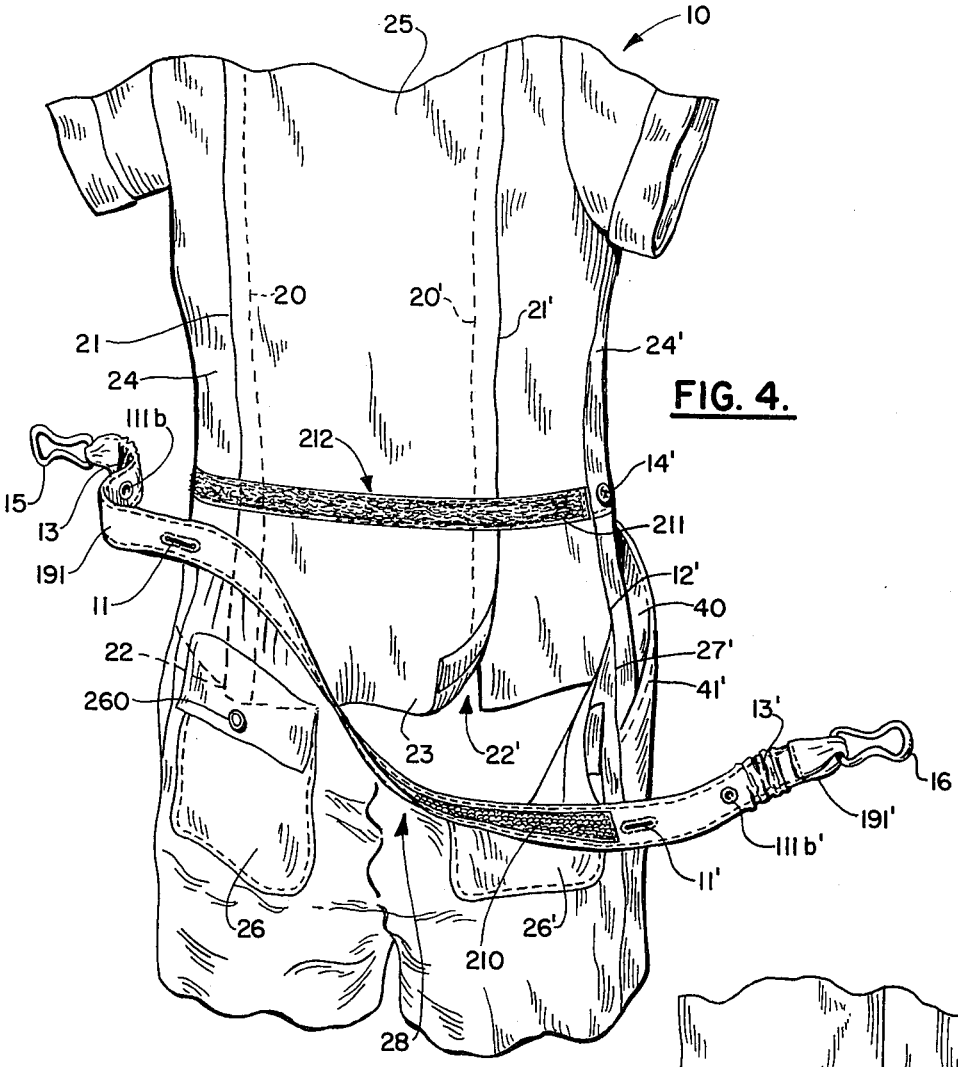
FIG. 4 is a back view of the preferred embodiment of jumpsuit garment of the present invention showing the belt detached from the jumpsuit garment device and the drop seat flap in a semi-lowered position, revealing the slit at the end of the shirt part of the back of the jumpsuit garment and the method of connection of the lower side seams of the jumpsuit garment to the drop seat flap.
Figure 6:
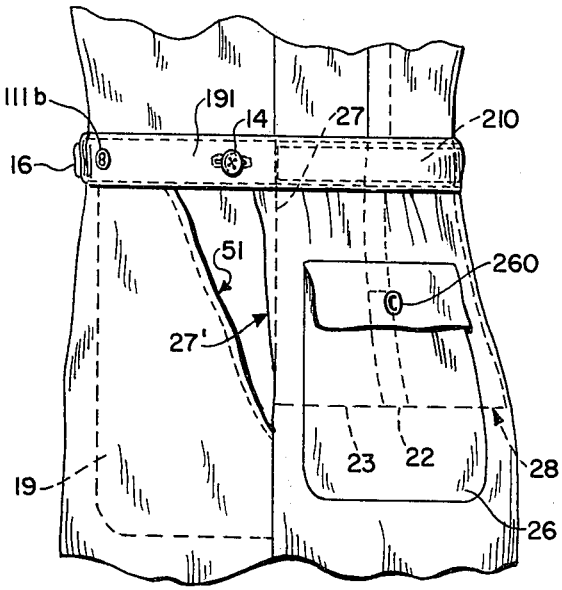
FIG. 6 is a side perspective view of the preferred embodiment of the jumpsuit garment of the present invention showing the drop seat flap in a raised position and the belt in a connected, secure state.
Figure 5:
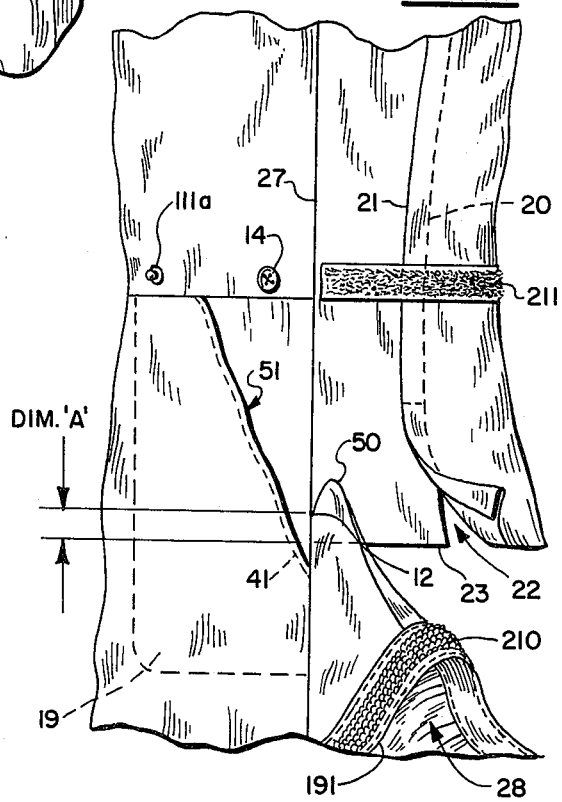
FIG. 5 is a side view of the preferred embodiment of the jumpsuit garment of the present invention showing the drop seat flap in a fully lowered position.

The back shirt portion 25 of the jumpsuit garment 10 has folds 20, 21 and 20', 21', terminating in the "hidden" slits 22, 22', running down the full length of the back shirt portion 25 of the jumpsuit garment 10. The slits 22, 22' begin at the waist line, as indicated by the phantom lined stitching in FIGS. 2 and 4–6. A detail, cross-sectional view of one of the folds is shown in FIG. 3. As illustrated in FIG. 3, the folds are "z" type folds which are straight in line and do not diverge from the center line of the garment. The folds separate the side parts 24 of the back portion 25 of the jumpsuit garment 10 from the rest or central part of the back shirt portion 25 of the jumpsuit garment 10. This separation permits the wearer of the jumpsuit garment to extend his upper limbs for large or small physical movements without discomfort or restraint by the jumpsuit garment and still permits the jumpsuit garment to present a non-baggy appearance when the wearer is not engaged in great physical activity. The folds 20, 21, and 20', 21' are each secured at a point two to two-and-a-half inches below the shoulder seam (not phantom lined stitching) and extend the full length of the back shirt portion 25 of the jumpsuit garment 10 and terminate through slits 22, 22' at "shirt tail" bottom edge 23, well below the level of the bilt 191, 191' and also below the bar tack stitching terminations 12 and 29 of the jumpsuit garment drop seat flap, as indicated by dimension A of FIG. 5.

The folds 20, 21 and 20', 21' ends in slits 22 and 22', respectively, at the bottom or tail piece 23 of the back shirt portion 25 of the jumpsuit garment 10. This permits hip expansion room for sitting and bending in the jumpsuit garment.

It is noted that the vertical folds 20–21, and 20'–21' and associated vertical slits 22, 22' are substantially removed from the side junction lines 27, 27' between the drop seat flap 28 and the tail piece part of the back portion 25 of the garment 10, and that the junction lines 27, 27' themselves are free of any slits.

The front pockets 40 and 51 are of course lined (note 19 and 19') and stay firm even when the drop seat flap 28 is in the lowered position because the side seam 27 is the only common connection between the two. The slight pucket 50 (note FIG. 5) is caused by the bar tack termination 12 of the drop seat flap 28 of the jumpsuit garment 10.

It should be noted that, because the additional attachments of the jumpsuits garment 10 to the belt 191, 191' of the drop seat flap 28 are at the side or towards the front of the jumpsuit garment 10 at 11, 11', 14, 14' optionally at the 111, 111', the only rear binding of the drop seat flap 28 to the jumpsuit garment 10 is by means of the pressure connection 212 which is releasable without manual intervention by the sheer or normal force caused by great physical movement. Therefore, the back shirt portion 25 of the jumpsuit garment 10 is free to pull or away as necessary for stretching and bending without permanent damage (ripping, button popping, etc). It should be further noted that the pressure connection 212 being for example of the "Velcro" type, is releasable without damage whether the releasing pressure is applied away from the connected surface (i.e. vertically to the surfaces), or laterally across them, as compared to for example snaps which release only when the releasing forces or pressures are applied vertically.

Thus, it is seen that the drop seat flap 28 is integrally connected to the body of the garment 10 only along its bottom edge and is connected along its side edges at only two points, a bottom fixed connection 12 and a top fastenable connection via belt 191, 191' with no fixed or fastenable connections therebetween or across the top edge except releasable, pressure connection 212.

In summary then, in the preferred embodiment of the present invention, the jumpsuit garment 10 is first fastened securely to the wearer by its front zipper and belting attachments for the drop seat flap 28. The wearer may then easily and quickly lower the drop seat flap 28 from the raised position by unbuckling the belt 101, 191' and detaching the two fixed buttons 11–14, 11'–14' and pulling the pressure connection free in the act of lowering belt 191, 191', thereby freeing all means of holding the drop seat flap 28 in the raised position. Additionally, extra back shirt folds 20 – 21, 20' – 21', and slits 22, 22' provided in the design permit large and small physical motion without interference from the jumpsuit garment 10.

Although the garment described in detail supra has been found to be most satisfactory and preferred, many variations in its structure or use are, of course, possible. For example, the jumpsuit garment may be used as a skiing suit instead of a worksuit. Also, the pants do not have to be full length of the upper thighs. Moreover, the elastic sections and the "Velcro" sections may be in one or more pieces. Also snaps, 111, 111' are optional.

The buckling clasps 15, 16 and the button fasteners 11 – 14, 11' – 14' and pocket fasteners 260, are standard and well known elements. Many other elements, such as for example standard belt buckles or snaps or zippers, respectively, could be substituted in their place.

The above are, of course, merely exemplary of the many possible changes or variations.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed as invention is:

1. In a unitary body garment that includes an improved drop seat design covering an opening in the "derriere" region of the garment, wherein the unitary body garment is to cover at least the upper and central torso of the body of the wearer including the shoulders, back, "derriere", and upper thighs, the improved drop seat design comprising:

a drop seat flap of generally rectangular configuration for covering the opening in the "derriere" region of the unitary body garment fixedly connected along its bottom edge to the main body of the garment;

dual belting means for supporting the drop seat flap in the raised or closed position attached to the opposite, upper, side edges of said drop seat flap;

attachment means, a portion of which is on said belting means, for securing said belting means along the side or the front of the garment at two places, one on each side of the garment, when desired by the wearer of the unitary body garment;

pressure connection means for releasably holding said dual belting means against the garment upon the application of pressure, said pressure connection means being releasable when pressure is applied either away from the pressure surfaces or across them without damage to said pressure means; said drop seat flap being located between the main body of the unitary body garment and said belting means with said drop seat flap being connected to the unitary body garment along the bottom edge of said drop seat flap and with said drop seat flap being connected to said belting means along the top edge of said drop seat flap; said belting means extending past the side edges of said drop seat flap and attachment means with said belting means being connected to said attachment means and said pressure connection means when said drop seat flap is in the raised position and being completely free from said unitary body garment when said drop seat flap is in the lowered position; said attachment means and pressure connection means being located between the garment and said belting means with said attachment means being connected to the waist side or front portions of the unitary body garment at two places, one on each side of the unitary body garment, and said attachment means being connected to said belting means when said drop seat flap is in the raised position.

2. The garment of claim 1 wherein there is further included buckling means at the end of said belting means for attaching the ends of said belting means together at the middle of the front of the unitary body garment.

3. The garment of claim 1 wherein the attachment means are a pair of buttons and buttonholes, with said buttons being located on the main body of the unitary body garment and said buttonholes being located on said belting means.

4. The garment of claim 1 wherein said pressure connection means is of the "Velcro" type.

5. The garment of claim 1 wherein the connections of said drop seat flap to the unitary body garment extends along a part of each side of said drop seat flap.

6. The garment of claim 1 wherein there is further included two folds in the back of the unitary body garment extending vertically along the full length of the back of the unit ary body garment, one on each side of the unitary body garment.

7. The garment of claim 1 wherein there is further included a tail piece in the back of the unitary body garment bridging across the full back of the unitary body garment and having two, free, vertical slits therein, both slits being substantially removed from the side junction lines between said drop seat flap and said tail piece.

8. The garment of claim 7 wherein there is further included two folds in the back of said unitary body garment extending vertically along the full length of the back of said unitary body garment, one on each side of said unitary body garment.

9. The garment of claim 8 wherein said folds terminate in line in said slits and said slits are hidden by said folds.

10. The garment of claim 7 wherein said tail piece goes straight across the rear opening of said unitary garment.

11. The garment of claim 7 wherein said tail piece extends below said fixed connection of said drop seat flap to the unitary body garment a distance of the order of three-fourths of an inch.

12. The garment of claim 1 wherein there is further included snap means for holding said belting means to the garment.

13. A unitary body garment that covers at least the upper and central torso including the shoulders, back, "derriere", and upper thighs, and includes an improved "drop seat" design, the improvement in the "drop seat" comprising the following structure:

a drop seat flap connected to the body of the garment along its bottom edge and being connected to the garment along its sides at only two points, a bottom fixed connection and a top fastenable connection with no fixed or fastenable connections therebetween;

a tail piece bridging at least substantially straight across the full back of the garment and having two, free, parallel, vertical slits therein, both slits being substantially removed from the side junction lines between the flap and the tail piece, said slits being located on opposite sides of the back center line of the garment; and a belt at and across the upper end of the drop seat flap having at least partially along its length an elastic section and pressure connection means for releasably holding said belt against the garment by pressure contact, said pressure connection means being releasable when pressure is applied either away from the pressure surfaces or across them without damage to said pressure connection means, the belt ends extending out past the side edges of the flap and being completely free from the body of the garment when the drop seat structure is used in operation.

14. The garment of claim 13 wherein there is further included two folds in the back of said unitary body garment extending vertically along the full length of the back of said unitary body garment, one on each side of said unitary body garment.

15. The garment of claim 14 wherein said folds terminate in line in said slits and said slits are hidden by said folds.

16. The garment of claim 15 wherein said folds are straight in line are "Z" type folds having the same identical "Z" fold cross-sections throughout their lengths.

17. The garment of claim 13 wherein said tail piece goes straight across the rear opening of said unitary garment.

18. The garment of claim 13 wherein said tail piece extends below said fixed connection of said drop seat flap to the unitary body garment a distance of the order of three-fourths of an inch.

19. The garment of claim 13 wherein there is further included-attachment means, a portion of which is on said belt, for securing said belt along the side or the front of the garment at two places, one on each side of the garment, when desired by the wearer of the unitary body garment, said attachment means being connected to said belt when said drop seat is in the raised position and being unconnected when said drop seat flap is in the lowered position.

20. The garment of claim 13 wherein said elastic section comprises elastic means for supporting the drop seat flap in the raised position, said elastic means being included integrally as a part of said belt in the back portion of the garment and extending along a substantial length of said belt.

21. The garment of claim 20 wherein said pressure means is of the "Velcro" type.

* * * * *